US007051987B2

(12) United States Patent
Chen

(10) Patent No.: US 7,051,987 B2
(45) Date of Patent: May 30, 2006

(54) LIQUID SOAP DISPENSER

(76) Inventor: Yi-Chen Chen, No. 107, Fusing 6th St., Jhongli City, Taoyuan County (TW)

( * ) Notice: Subject to any disclaimer, the term of this patent is extended or adjusted under 35 U.S.C. 154(b) by 189 days.

(21) Appl. No.: 10/630,683

(22) Filed: Jul. 31, 2003

(65) Prior Publication Data

US 2005/0077385 A1 Apr. 14, 2005

(51) Int. Cl.
*A47B 23/04* (2006.01)

(52) U.S. Cl. ..... 248/447.1

(58) Field of Classification Search ..... 222/129, 222/181.1, 153.01, 153.03, 160, 173, 493; 248/447.1
See application file for complete search history.

(56) References Cited

U.S. PATENT DOCUMENTS 4,493,440 A * 1/1985 von Buelow et al. ..... 222/109
5,183,182 A * 2/1993 Comstock et al. ..... 222/129
6,131,773 A * 10/2000 Wade et al. ..... 222/153.02
6,209,184 B1 * 4/2001 Copeland et al. ..... 29/428
2002/0084288 A1 * 7/2002 Lewis et al. ..... 222/181.1

* cited by examiner

*Primary Examiner*—Philippe Derakshani
(74) *Attorney, Agent, or Firm*—Birch, Stewart, Kolasch & Birch, LLP

(57) ABSTRACT

A liquid soap dispenser including a stationary base and a main body with a cover. A fastener is on the bottom of the stationary base, a concave is on top of the stationary base, a blocking board is on top of the concave, a holding hole with an opening on top is located on the concave; the main body is in box shape with a "T" shape pillar on the back, a slot is on the bottom of the back of the main body; an inner brim is on the top of the main body to fit the inner cover, a protruding rib is on the back of the cover, a blocking brim surrounds the cover, a lock hole is located on the front of the blocking brim, and a lock is inside the lock hole to lock the cover and the stationary base.

6 Claims, 6 Drawing Sheets

LIQUID SOAP DISPENSER

BACKGROUND OF THE INVENTION

I. Field of the Invention

This invention relates generally to a liquid soap dispenser and, more specifically, to a liquid soap dispenser that interlocks the stationary base, the main body and the cover for better anti-theft and water anti-permeation effect.

II. Description of the Prior Art

Heretofore, it is known that the structure a liquid soap dispenser (as shown in FIG. 6) consists of a main body (70) and a fixing base (80) nailed on wall; the main body (70) further consists of a transmission mechanism on base, top portion is the storage of the liquid soap, a cover (71) is on top of the main body (70), a fastening slot (72) is on the lower back portion of the main body (70); the filing base (80) is a small board with several lock hole (82) on sides for screws to pass through, a fastener (81) is on the center of the fixing base (80).

The fixing base (80) is fixed on wall with screws on the lock hole (82), the main body (70) filled up with liquid soap is fixed on the fastener (81) of the fixing base (80) with the fastening slot (72) to combine the two structures.

However the above mechanism contains following deficiencies:

1. No special locking device installed between the main body (70) and the fixing base (80); anyone can just pull up the main body (70) from the fixing base (80) easily.
2. The cover (71) of the main body (70) does not have locking device, the liquid soap inside might be mixed with other materials purposely; the cover (71) is a flat plate, no sealing and water-blocking design, dirty water will permeate in that causes contamination.
3. Some cleaners and detergents contain alcohol or scent materials, if the cover (71) and the main body (20) are not sealed closely, alcohol and scent materials will evaporate after sometimes, the scent smell and sterilizing effect will degrade.
4. No fixing mechanism for the cover (71), when the cover (71) is lifted for refill, the cover (71) might drop accidentally due to gravity or minor touch that causes inconvenience during refill of liquid soap.

SUMMARY OF THE INVENTION

It is therefore a primary object of the invention to provide a liquid soap dispenser to solve the deficiencies mentioned above and easy to combine, better anti-theft effect, better water-proof effect.

In order to achieve the objective set forth, a liquid soap dispenser in accordance with the present invention comprises a stationary base and a main body with a cover. A fastener is on the bottom of the stationary base, a concave is on top of the stationary base, a blocking board is on top of the concave, a holding hole with an open on top is located on the concave; the main body is in box shape with a "T" shape pillar on the back, a slot is on the bottom of the back of the main body; an inner brim is on the top of the main body to fit the inner cover, a protruding rib is on the back of the cover, a blocking brim surrounds the cover, a lock hole is located on the front of the blocking brim, a lock is inside the lock hole to lock the cover and the stationary base, the cover and the stationary base are further fastened with the protruding rib, the main body and the stationary base are interlocked with the "T" shape pillar and the fastener, the slot two fastening mechanisms, the interlock structure is best for anti-theft effect

BRIEF DESCRIPTION OF THE DRAWINGS

The present invention will become more fully understood from the detailed description given hereinbelow and the accompanying drawings, which are given by way of illustration only, and thus are not limitative of the present invention, and wherein.

DESCRIPTION OF THE PREFERRED EMBODIMENT

Figure 1:
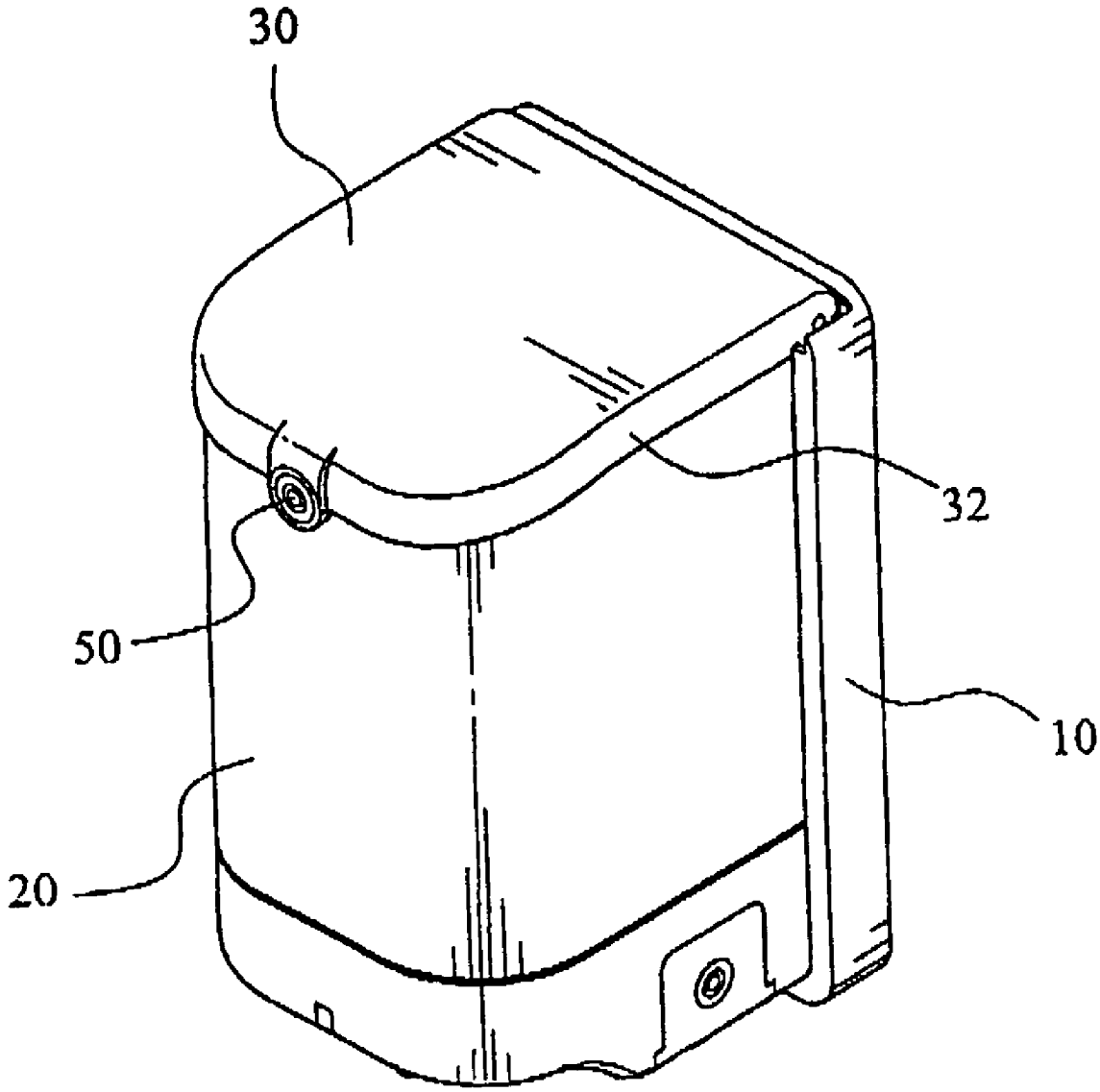
FIG. 1 is a perspective view of the present invention.
Figure 2:
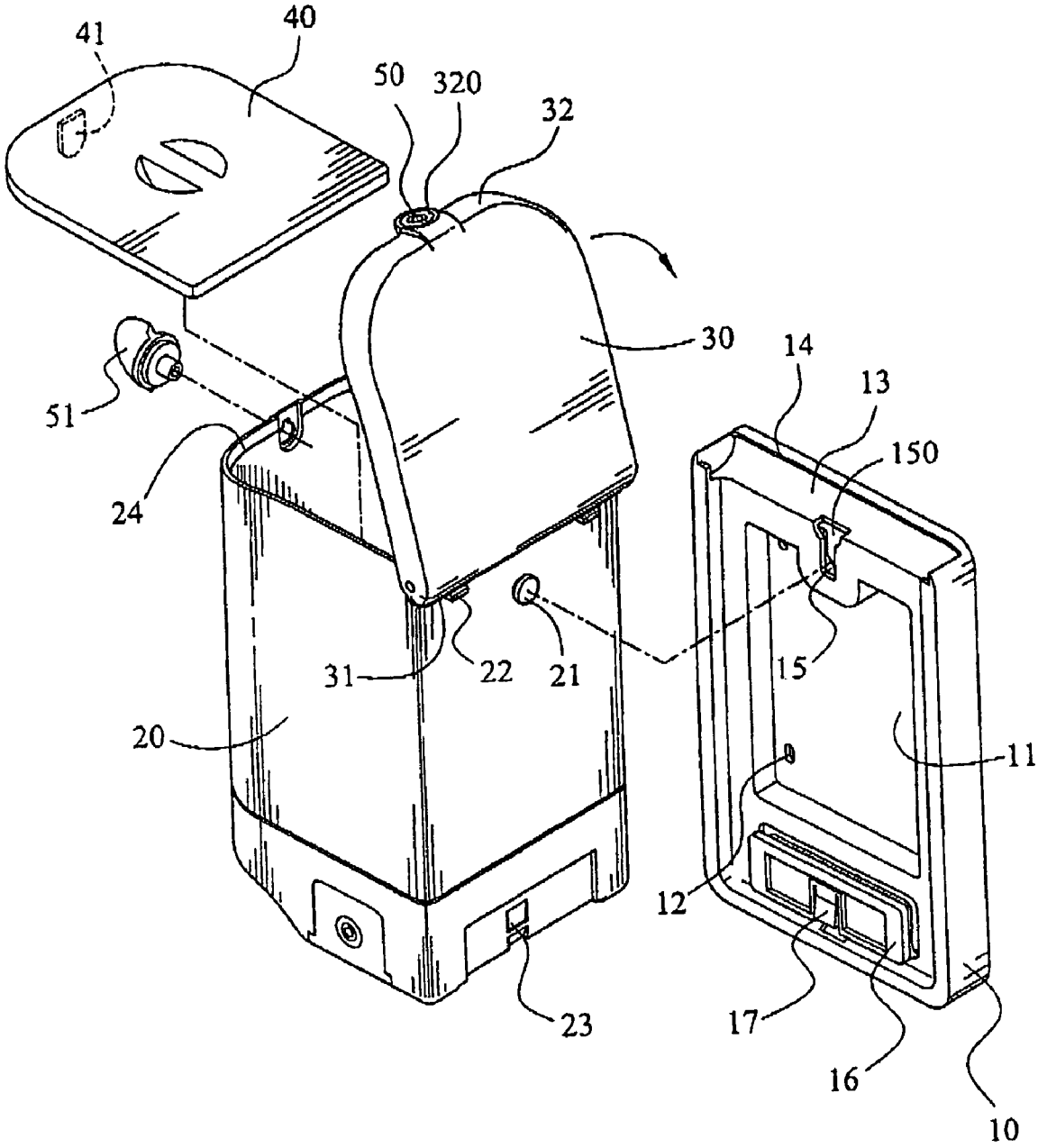
FIG. 2 is an assembly view of the present invention.
Figure 3:
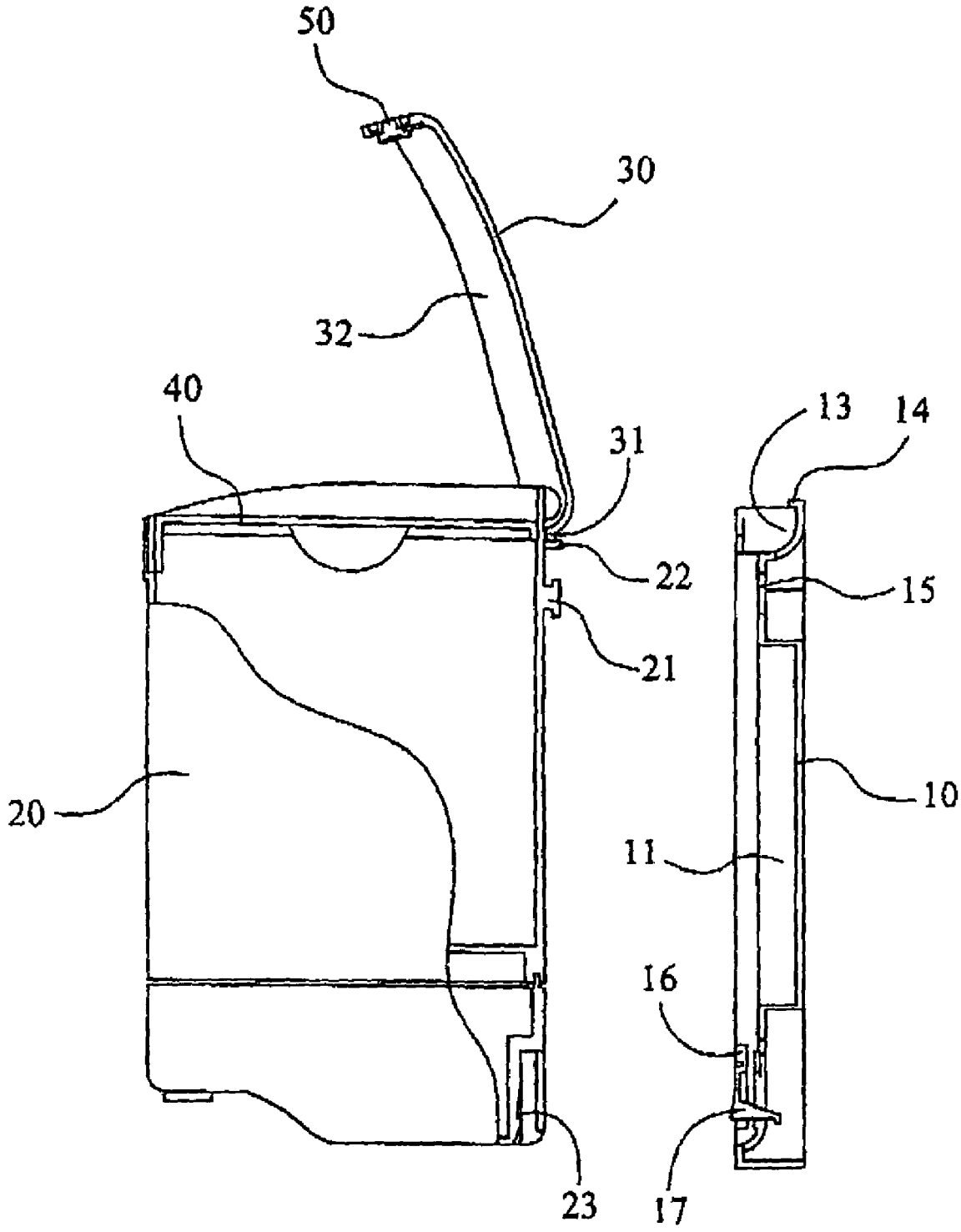
FIG. 3 is a cross-sectional view of the present invention.

Referring to FIG. 1, FIG. 2 and FIG. 3, the present invention is composed of a stationary base (10) and a main body (20) with a cover (30). The stationary base (10) is slightly larger than the main body (20), a fastener (16) is on the bottom, a spring shape tenon (17) located on top of the fastener (16); a concave (13) is on top of the stationary base (10), a blocking board (14) is on top of the concave (13), a holding hole (15) with an open (150) on top locates on the concave (13), a concave area (11) is on the center of the stationary base (10), several nail hole (12) are on the concave area (11).

The main body (20) is in box shape with a "T" shape pillar (21), a protruding hook (22) is on the lower portion of the cover (30), a slot (23) is on the bottom of the back of the main body (20); an inner brim (24) is on the top of the main body (20) to fit the inner cover (40).

A protruding rib (31) is on the back of the cover (30), a blocking brim (32) surrounds the cover (30); a lock hole (320) is located on the front of the blocking brim (32), a lock (50) is inside the lock hole (320).

A blocking plate (41) is on the front of the inner cover (40) so that the blocking plate (41) can cover the inner side the lock (50) of the cover (30) when the inner cover (40) is on the inner brim (24) of the main body (20), water will not come in to cause contamination.

Figure 4:
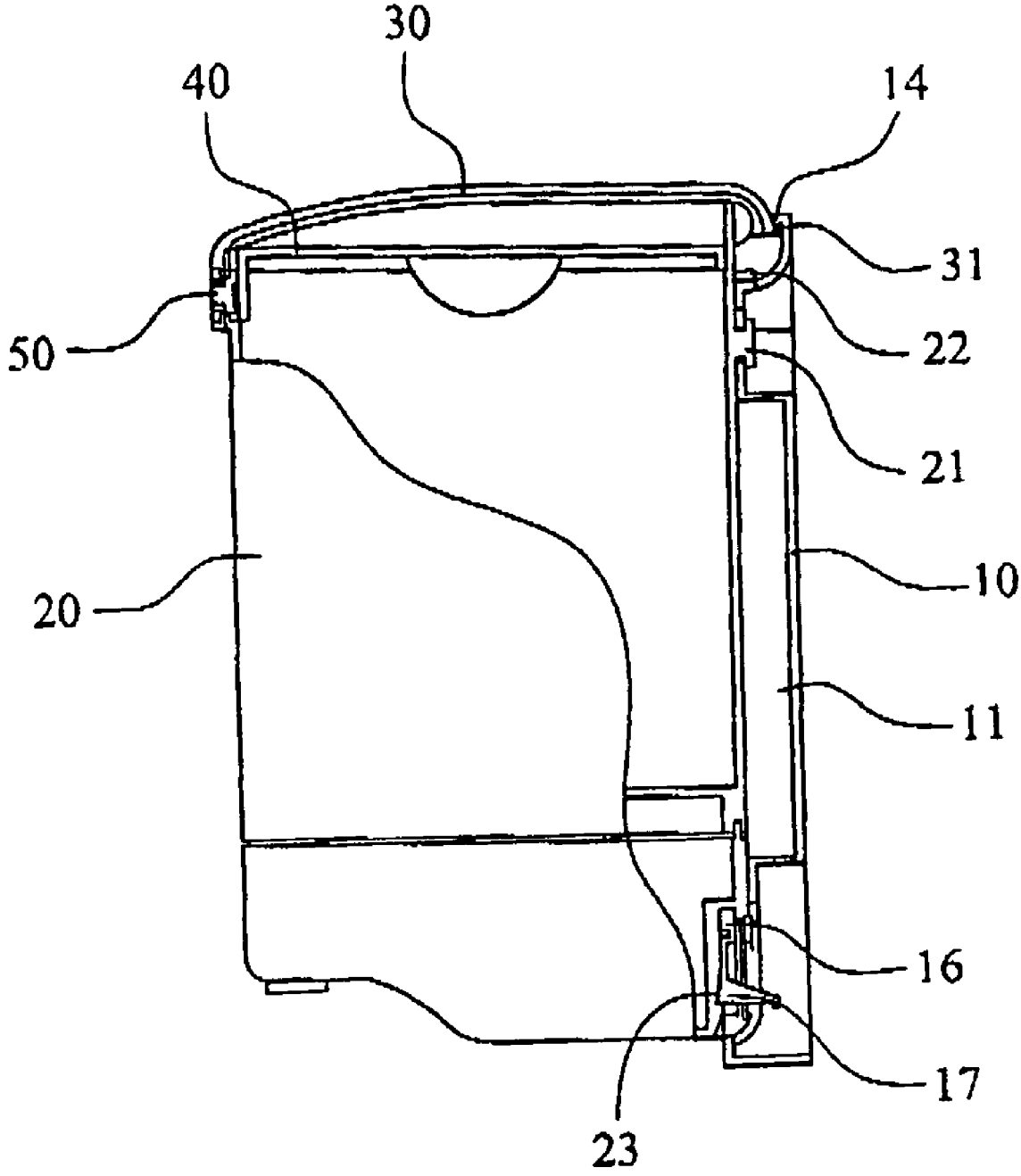
FIG. 4 is another cross-sectional view of the present invention.

Referring to FIG. 2 and FIG. 3, the cover (30) has to be opened first to install main body (20) to the stationary base (10), as shown in FIG. 3, when the cover (30) lifts, the protruding rib (31) inserts into the protruding hook (22); referring to FIG. 2, FIG. 3 and FIG. 4, the stationary based (10) is installed and fixed on wall with nails passing through nail hole (12). The main body (20) attaches to the holding hole (15) from the top down of the opening (150) with the "T" shape pillar (21), at the same time, the slot (23) is also installed onto the fastener (16); as shown in FIG. 4, the cover (30) is pushed down, at the same time, the protruding rib (31) on the back can push the inner brim of the blocking board (14) from the concave (13), the blocking brim (32) of the cover (30) covers the upper brim of the main body (20), janitors can lock the lock (50) and main body (20) together with a key (51), now the stationary base (10), main body (20) and the cover (30) are fastened together for anti-theft effect.

Figure 5:
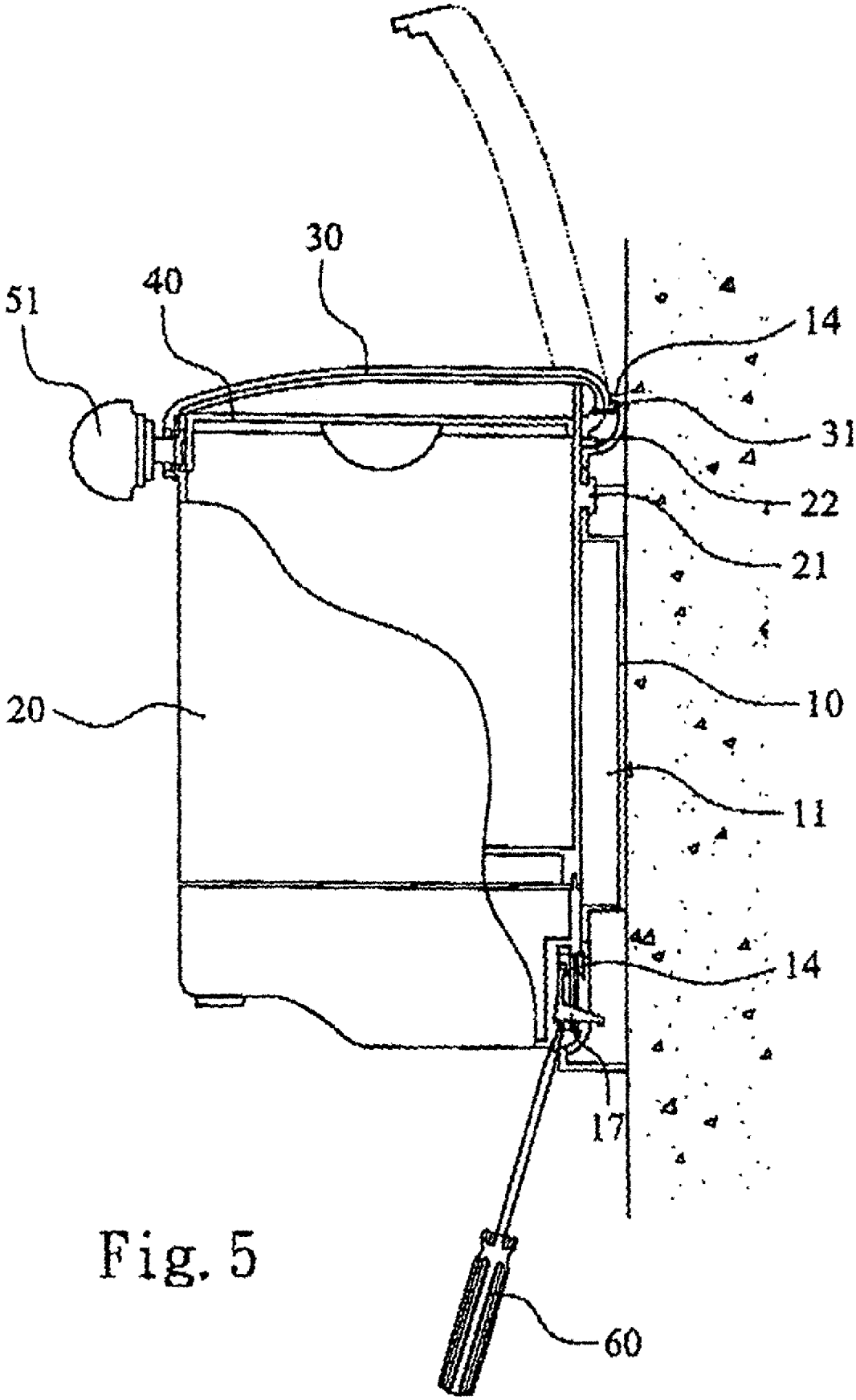
FIG. 5 is an assembly cross-sectional view the present invention.
Figure 6:
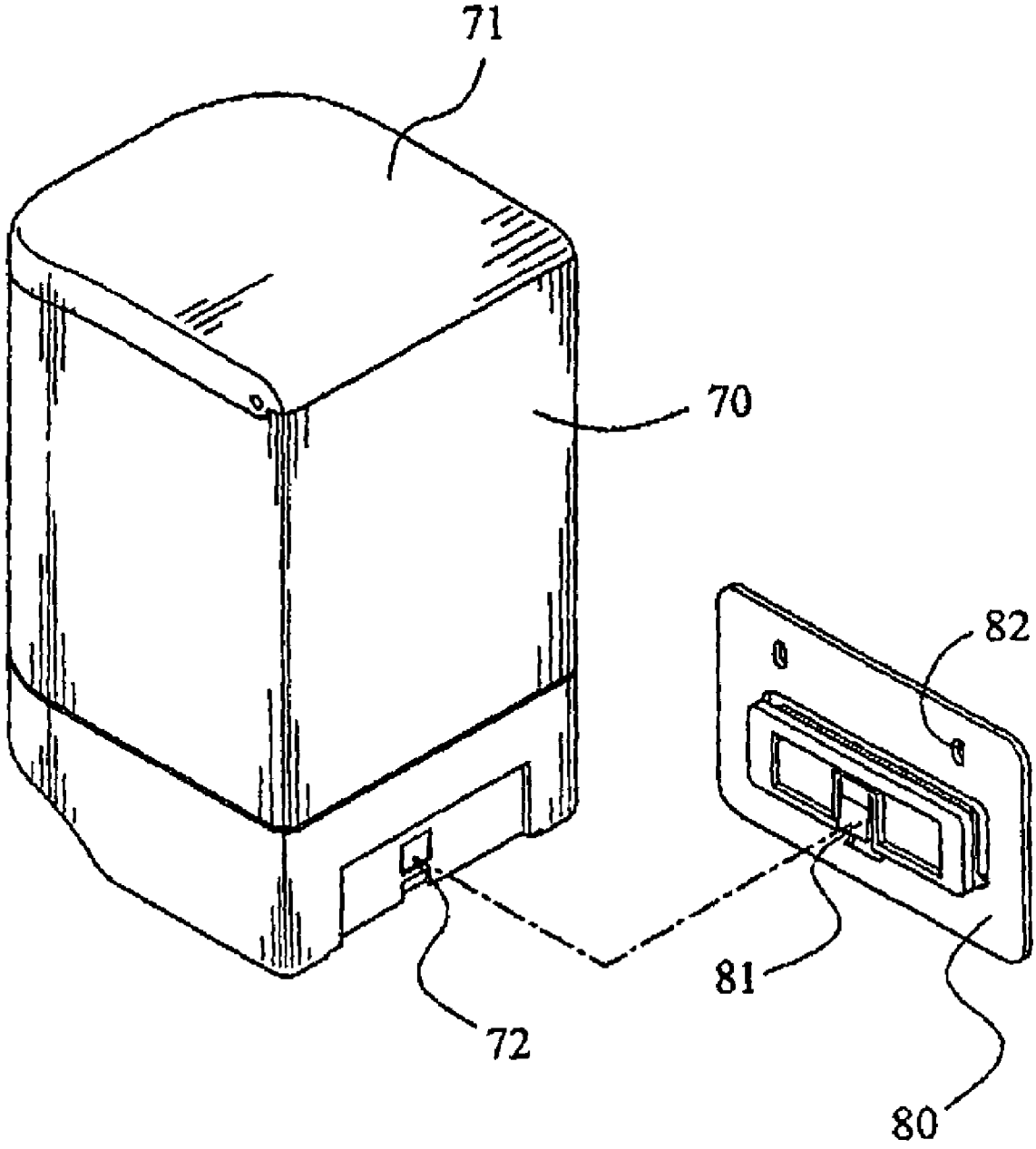
Fig. 6 (PRIOR ART)
FIG. 6 is a perspective view with the prior art.

When users want to disassemble the device, as shown in FIG. 5, users apply the key (51) to unlock the lock (50), lift the cover (30), press the spring shape tenon (17) on the bottom of the stationary base (10) with a screw driver (60), the main body (20) can be separated from the stationary base (10).

Referring to FIG. 5, when the cover (30) is lifted up from the main body (20), as shown in FIG. 3, the protruding rib (31) on the back of the cover (30) stems inside the protruding hook (22) and remains stable with the main body (20), when the users refill the liquid soap, the cover (30) remains open, such mechanism is very convenient.

The present invention has following advantages:

1. The lock (50) can lock the main body (20) and the cover (30), the protruding rib (31) can fasten the cover (30) and the stationary base (10), the "T" shape pillar (21) and fastener (16), the slot (23) two fastening mechanisms to fix the main body (20) and the stationary base (10), all the components are interlocked for best anti-theft effect.
2. The blocking brim (32) surrounding the cover (30) can seal the upper part of the main body (20) from water, the lock (50) on the blocking brim (32) also prevent water from permeating into liquid soap.
3. The inner cover (40) of the main body (20) can prevent the evaporation of alcohol and scent materials inside the cleaners that prolong the effectiveness of the cleaners.
4. The protruding rib (31) on the back of the cover (30) not only fasten the stationary base (10) and the main body (20) but also inserts into the protruding hook (22) when the cover (30) is lifted to make the cover (30) stable that make the refill operation very convenient.

While a preferred embodiment of the invention has been shown and described in detail, it will be readily understood and appreciated that numerous omissions, changes and additions may be made without departing from the spirit and scope of the invention.

What is claimed is:

1. A liquid soap dispenser comprising:

a stationary base with several nail holes;

a main body, separate from said stationary base, with a cover;

a fastener located on a bottom of said stationary base for holding said stationary base to said main body;

a concave located on top of the stationary base;

a blocking board on top of said concave, a holding hole for holding said stationary base to said main body located on said concave;

said main body being in a box shape with a "T" shape in cross-section pillar on back, a slot being on the lower portion of the back of said main body;

a protruding rib located on the back of said cover, a blocking brim surrounding said cover, a lock hole located on the front of said blocking brim, and a lock inside said lock hole.

2. The liquid soap dispenser recited in claim 1, further comprising a protruding hook located on the lower portion of the cover for receiving said protruding rib.

3. The liquid soap dispenser recited in claim 1, further comprising an opening located on top of said holding hole on said stationary base.

4. The liquid soap dispenser recited in claim 1, further comprising a spring shape tenon located on top of said fastener on said stationary base.

5. The liquid soap dispenser recited in claim 1, further comprising a concave area on the center of said stationary base, said nail hole being on said concave area.

6. The liquid soap dispenser recited in claim 1, further comprising an inner brim located on the top of said main body to fit the inner cover.

* * * * *